US010619962B1

(12) United States Patent
Hatfield

(10) Patent No.: US 10,619,962 B1
(45) Date of Patent: Apr. 14, 2020

(54) SOUND SUPPRESSOR FOR A FIREARM

(71) Applicant: Ted Hatfield, Kansas City, MO (US)

(72) Inventor: Ted Hatfield, Kansas City, MO (US)

( * ) Notice: Subject to any disclaimer, the term of this patent is extended or adjusted under 35 U.S.C. 154(b) by 141 days.

(21) Appl. No.: 15/902,662

(22) Filed: Feb. 22, 2018

Related U.S. Application Data

(60) Provisional application No. 62/464,478, filed on Feb. 28, 2017.

(51) Int. Cl.

| | |
|---|---|
| ***F41A 21/30*** | (2006.01) |
| ***F41A 21/24*** | (2006.01) |
| ***F41A 13/12*** | (2006.01) |
| ***F41A 21/44*** | (2006.01) |
| *F41A 21/00* | (2006.01) |
| *F41A 13/00* | (2006.01) |
| *F01N 1/08* | (2006.01) |
| *F41A 21/34* | (2006.01) |

(52) U.S. Cl.
CPC ..... *F41A 21/30* (2013.01); *F41A 21/44* (2013.01); *F01N 1/083* (2013.01); *F41A 21/34* (2013.01)

(58) Field of Classification Search
CPC ..... F41A 21/30; F41A 21/34; F41A 21/44; F41A 21/24; F41A 13/12
See application file for complete search history.

(56) References Cited

U.S. PATENT DOCUMENTS

| | | | | |
|---|---|---|---|---|
| 621,085 | A * | 3/1899 | Hookham | F41A 21/24 89/14.1 |
| 2,287,066 | A * | 6/1942 | Rogers | F41A 13/12 89/14.05 |
| 2,337,840 | A * | 12/1943 | Scott-Paine | F41A 13/12 89/14.1 |
| 3,118,243 | A * | 1/1964 | Manshel | F41A 21/02 42/76.02 |
| 3,710,679 | A * | 1/1973 | Werbell, III | F41A 21/30 89/14.4 |
| 3,727,513 | A * | 4/1973 | Wicks | F41A 13/12 89/14.1 |
| 6,508,159 | B1 * | 1/2003 | Muirhead | F41A 21/24 42/76.01 |
| 7,464,496 | B1 * | 12/2008 | Davies | F41A 21/24 42/75.02 |
| 7,735,408 | B1 * | 6/2010 | Becker | F41F 1/06 102/374 |
| 8,991,551 | B2 * | 3/2015 | Latka | F41A 21/30 181/223 |
| 9,239,202 | B2 * | 1/2016 | Michal | F41A 21/24 |
| 9,347,727 | B1 * | 5/2016 | Cler | F41A 21/30 |
| 9,933,224 | B2 * | 4/2018 | Dorne | F41A 21/30 |
| 10,107,581 | B2 * | 10/2018 | Garst | F41A 21/30 |

(Continued)

FOREIGN PATENT DOCUMENTS

| | | | | |
|---|---|---|---|---|
| DE | 2712458 | A1 * | 9/1978 | F41A 13/12 |

*Primary Examiner* — Edgardo San Martin
(74) *Attorney, Agent, or Firm* — Ronald J. Koch; The Eley Law Firm

(57) ABSTRACT

A sound suppressor for a firearm has one or more stacked baffles surrounded by an outer sleeve positioned such that an air gap exists between the baffles and the sleeve. The sleeve is connected to an outer portion of each of front and rear caps. The baffles are connected between the front and rear caps. The outer portions of the front and rear caps are disproportionately ventilated to induce directional air flow so as to facilitate heat dissipation.

7 Claims, 17 Drawing Sheets

(56) References Cited

U.S. PATENT DOCUMENTS

| | | | | |
|---|---|---|---|---|
| 10,180,299 | B2 * | 1/2019 | Morreau | F41A 21/34 |
| 10,234,231 | B2 * | 3/2019 | Gianelloni, III | F41A 21/34 |
| 2014/0059913 | A1 * | 3/2014 | Diamond | F41C 27/00<br>42/90 |
| 2019/0072352 | A1 * | 3/2019 | Garst | F41A 21/30 |

* cited by examiner

FIG. 3A (B-B)

Blast Chamber 8
44
External heatsink pattern for thermal transfer to internal air volume
SECTION C-C
SCALE 1:1
Bearing surface for alignment
5
Interference locking counterbore cut
5
Through holes into internal air volume

C
C
8
8

Eccentric locking surface
4
Alignment notch
5
Through holes into internal air volume

SECTION A-A

Units: inches

Units: inches

Units: inches

Units: inches

SECTION B-B

Units: inches

SECTION C-C

Units: inches

SECTION D-D

Units: inches

SECTION E-E

Units: inches

SECTION F-F

SOUND SUPPRESSOR FOR A FIREARM

CROSS-REFERENCE TO RELATED APPLICATIONS

This application claims priority to U.S. provisional application 62/464,478, filed Feb. 28, 2017, the contents of which are hereby incorporated by reference.

BACKGROUND AND SUMMARY

The subject technology relates generally to firearms accessories and specifically to firearm sound suppressors (aka suppressors).

Sound suppressors for firearms are widely known in the gun and shooting sports communities and are used to mitigate the noise associated with the firing of weapons. The theory of sound suppression is founded upon the redirection of a large portion of the gas associated with ignition of a round of ammunition from the muzzle of the firearm. Adding a suppressor at the muzzle of a firearm directs the gases from a fired round into blast chambers formed within the suppressor by a succession of stacked spacer components called baffles. The greater the amount of gas that can be directed to blast chambers within the suppressor and prevented from rapidly exiting the muzzle of the firearm, the greater the degree of achieved suppression of sound.

Unfortunately, the more hot gases that are redirected within the suppressor, the hotter the suppressor gets during operation. This heat presents a problem, especially when using lighter weight metals or composite plastics as components within the device or in connection with the outer tube (aka sleeve) of the suppressor. In one aspect of the subject technology, the structure of the suppressor is configured such that those interior core components that are more susceptible to heat buildup are substantially thermally isolated from the outer tube. A cooling plenum, or air gap, is provided between the core components and outer tube. Additionally, ports in the front and rear end caps are in operative engagement to the air gap, so as to encourage a cooling air flow.

In one aspect of the subject technology, the suppressor is constructed in such a manner so as to create a metallic core assembly that is thermally isolated from an outer sleeve which may be fabricated from carbon fiber or other composite material. The carbon fiber outer sleeve (aka outer tube) has desirable strength and weight characteristics, and is made from carbon fiber cloth or tow weave utilizing a high temperature resistant carbon fiber resin and/or a composite laminate construction that utilizes a layer of ceramic cloth bonded to the carbon fiber cloth to create a thermal barrier.

In one aspect, the subject technology comprises a series of stacked and/or coupled baffles which form a series of blast chambers, one of which may include a flash suppressor, all enclosed within a carbon fiber outer sleeve.

In one aspect of the subject technology, the problem of mitigating the overheating of suppressors is solved by incorporating an outer cooling plenum with induced airflow therein, surrounding a series of stacked and/or coupled baffles, one or more of which acting as blast chambers.

BRIEF DESCRIPTION OF THE DRAWINGS

Further features of the inventive aspects will become apparent to those skilled in the art to which the aspects relate from reading the specification and claims with reference to the accompanying drawings, in which:

FIG. 3A is the side sectional view of a baffle in one aspect of the subject technology;

DETAILED DESCRIPTION

Figure 1:
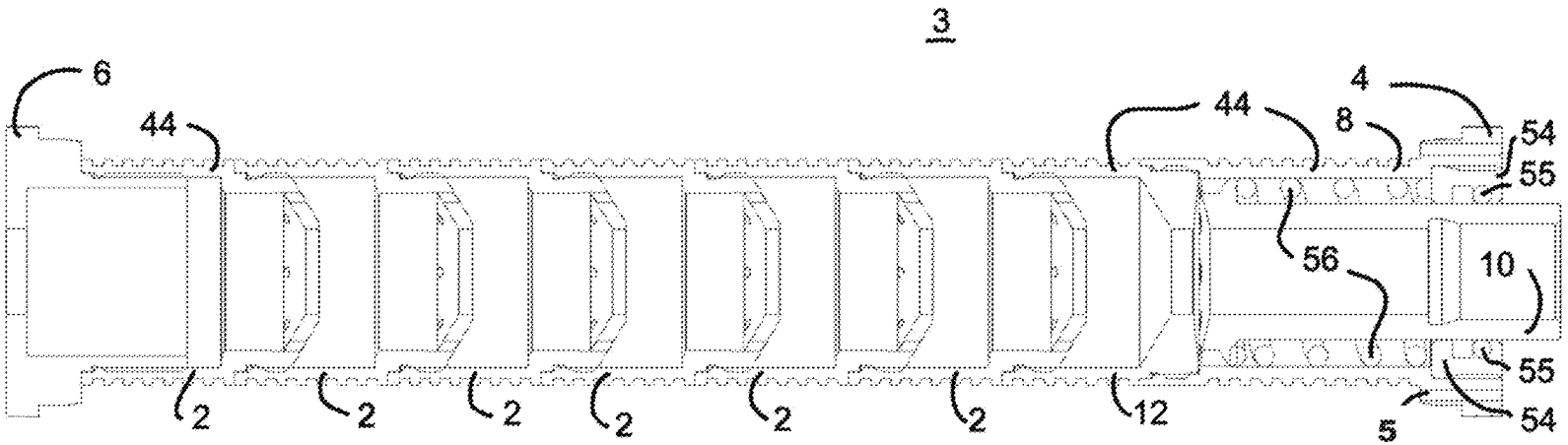
FIG. 1 is side sectional view of a suppressor in one aspect of the subject technology with the outer sleeve removed.
Figure 2:
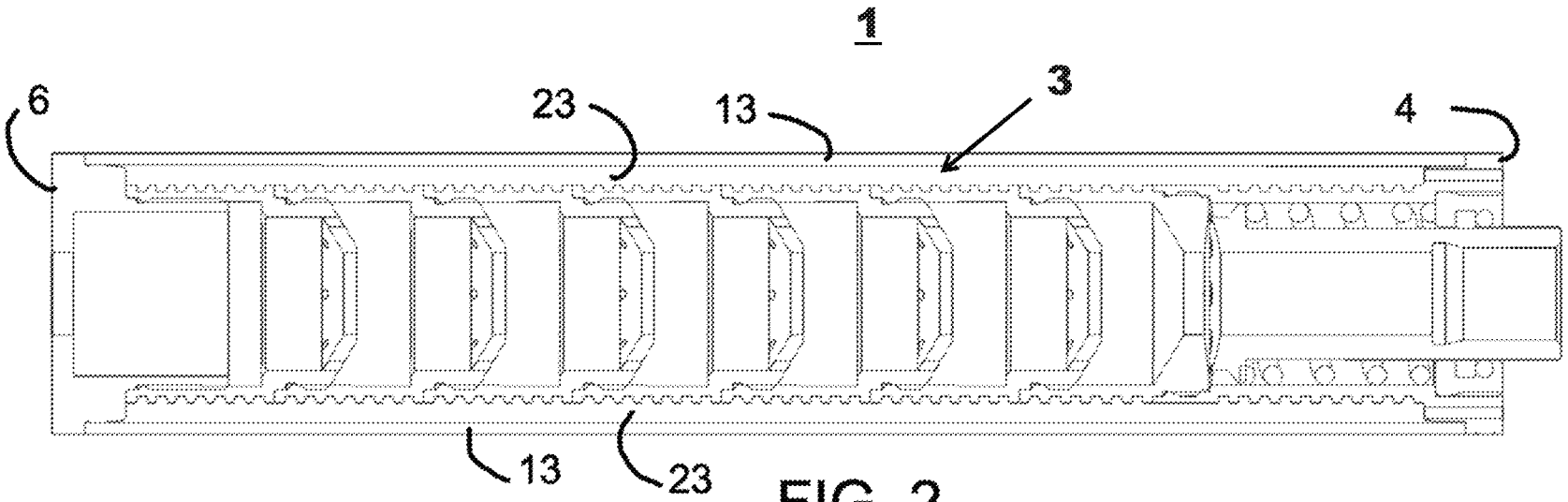
FIG. 2 is the side sectional view of the suppressor of FIG. 1 with the outer sleeve assembled thereon.

The general arrangement of a suppressor 1 for a firearm is shown in FIGS. 1 through 9 according to various aspects of the subject technology. In one aspect, suppressor 1 includes a core assembly 3 surrounded by an outer sleeve 13. Core assembly 3 and outer sleeve 13 are capped at the rear end by a rear cap 4 and at the front end by a front cap 6. In some aspects, rear cap 4 is integral to an exterior end of a blast chamber 8. In other aspects, rear cap 4 is a separate piece.

In one aspect, core assembly 3 includes six operatively coupled (aka stacked, or placed in a stacked arrangement) baffles 2, primary baffle 12, muzzle adapter 10, blast chamber 8, and front and rear caps 6, 4. Muzzle adapter 10 is operatively connected to blast chamber 8 such that muzzle adapter 10 is radially inside of blast chamber 8. Blast chamber 8 is operatively connected to a first end of primary baffle 12. A second end of primary baffle 12 is operatively connected to the stacked baffles 2 on a first end. A second end of stacked baffles 2 is operatively connected to front cap 6. The foregoing connectivity of blast chamber 8, muzzle adapter 10, primary baffle 12, stacked baffles 2, each individual baffle 2 as connected together to form stacked baffles 2, and front cap 6 can be achieved by threaded connection (e.g. FIGS. 3A-E, FIGS. 4A-D), friction fit (e.g. FIGS. 1-2, FIGS. 8-9), retention ring, or other means of attachment as will be appreciated by those of skill in the art.

In some aspects, muzzle adapter 10 is operatively connected to blast chamber 8. In some aspects (FIG. 5, FIG. 7A-D), muzzle adapter 10 incorporates a flash suppressor, and is configured to utilize an eccentric surface (FIGS. 7A-D) to lock the suppressor to it when the suppressor is rotated a half turn.

Figures 7A, 7B, 7C, 7D:
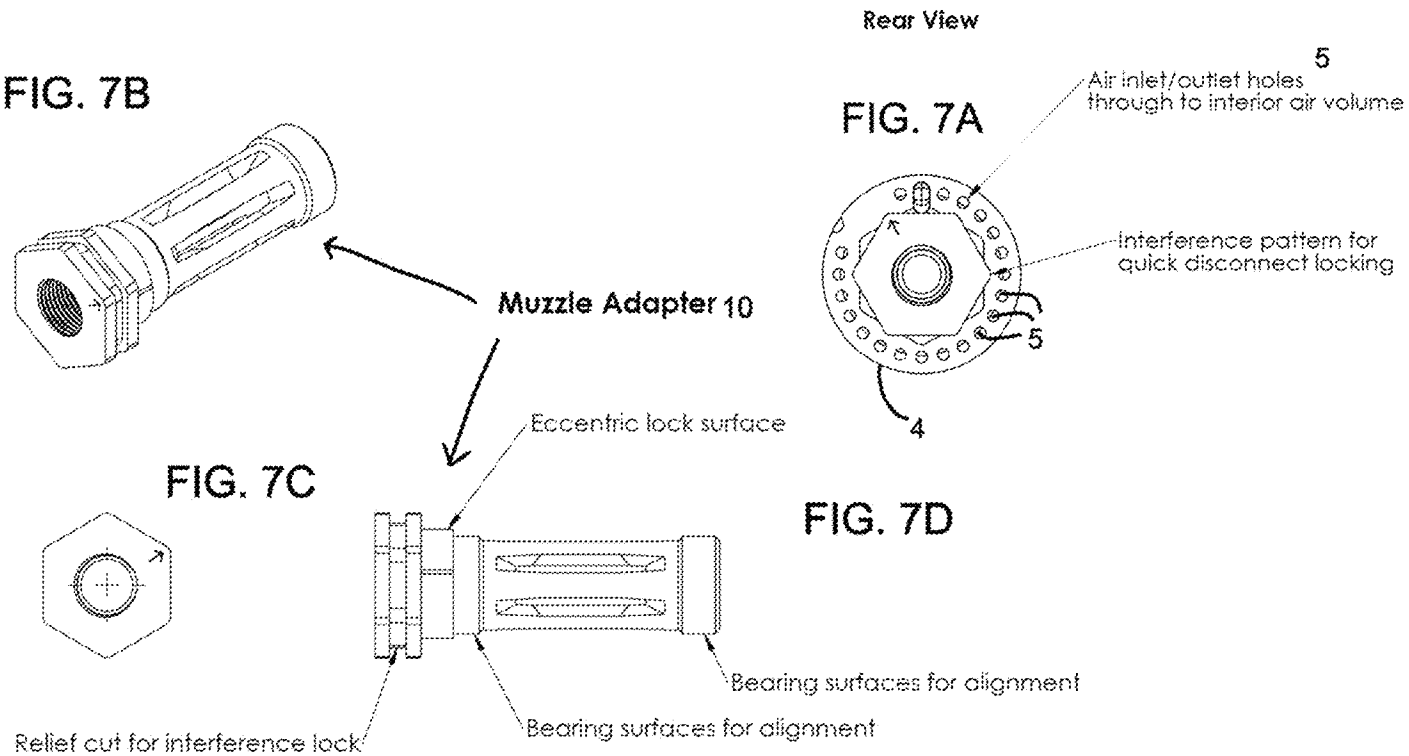
FIG. 7A is the rear view of the muzzle adapter of FIG. 7B.
FIG. 7B is the rear side perspective view of the muzzle adapter of FIG. 7A.
FIG. 7C is the rear view of the muzzle adapter of FIG. 7A.
FIG. 7D is the side elevation view of the muzzle adapter of FIG. 7A.
Figure 8:
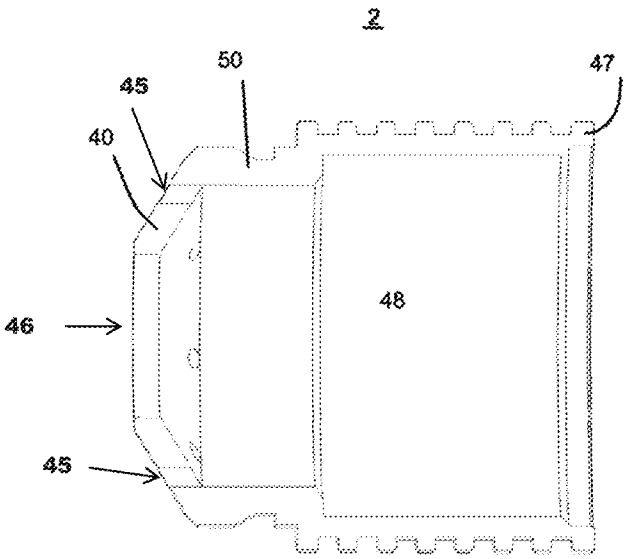
FIG. 8 is the side sectional view of a baffle in one aspect of the subject technology.
Figure 9:
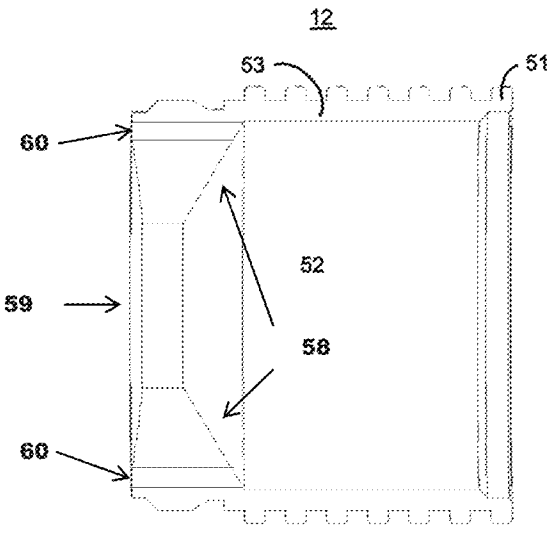
FIG. 9 is the side sectional view of a primary baffle in one aspect of the subject technology.
Figure 10A:
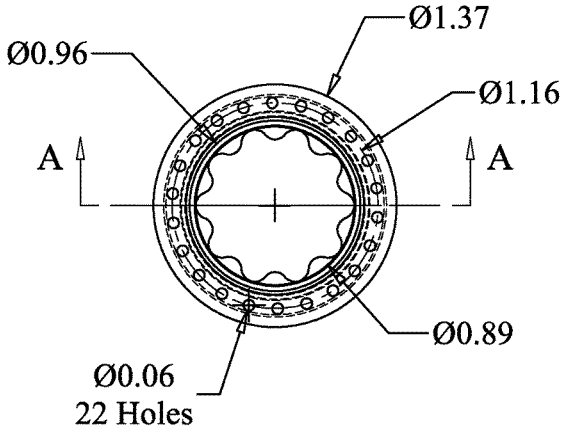
FIGS. 10A-D are the rear, side, side sectional and perspective views of a blast chamber in one aspect of the subject technology.
Figure 10B:
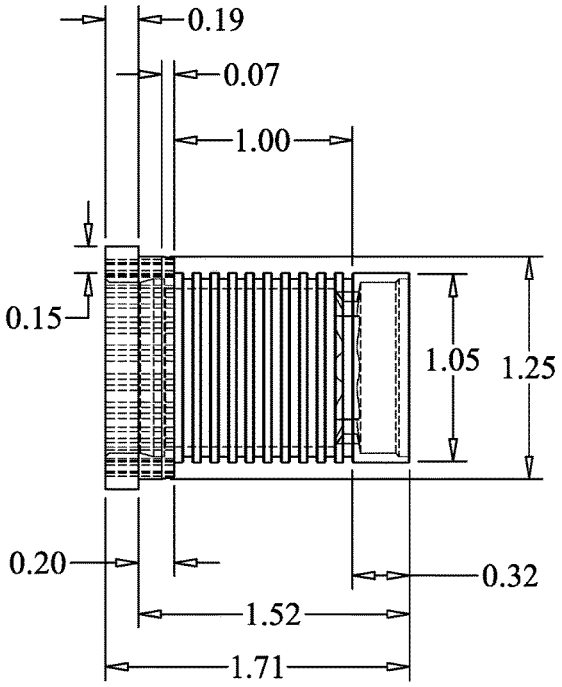
Figure 10C:
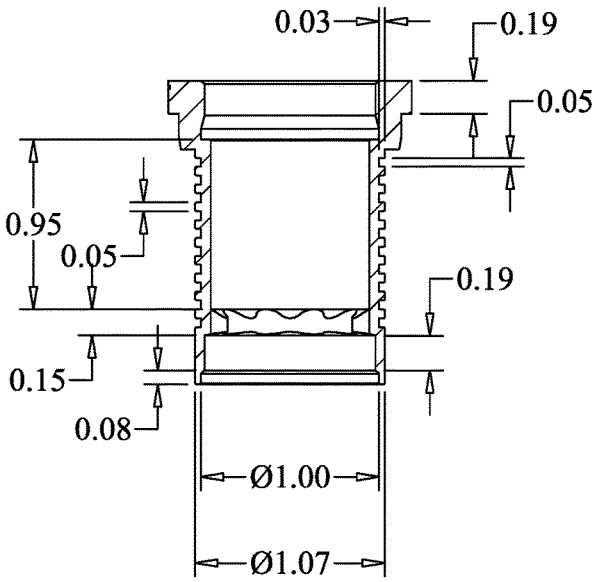
Figure 10D:
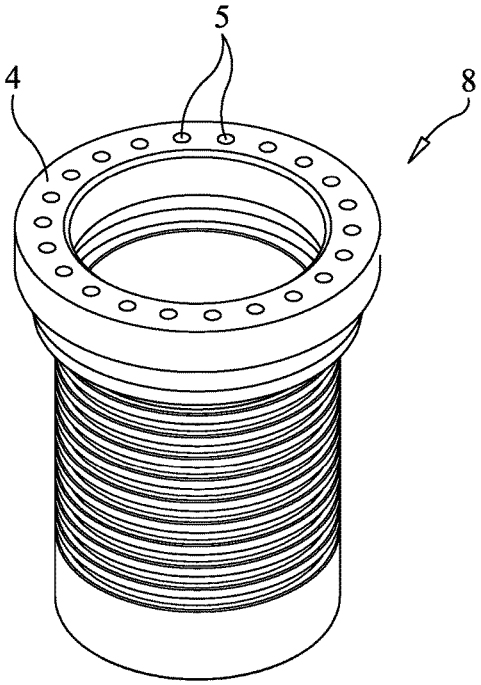
Figure 11A:
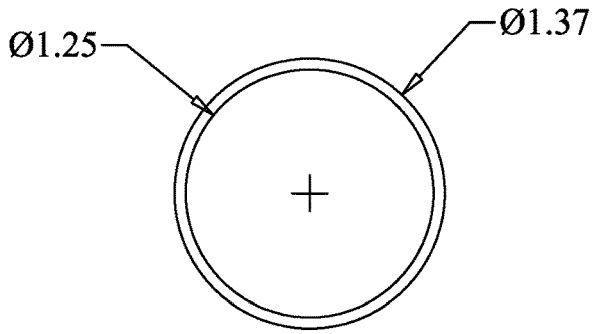
FIGS. 11A-C are the front, side, and perspective views of an outer sleeve in one aspect of the subject technology.
Figure 11B:
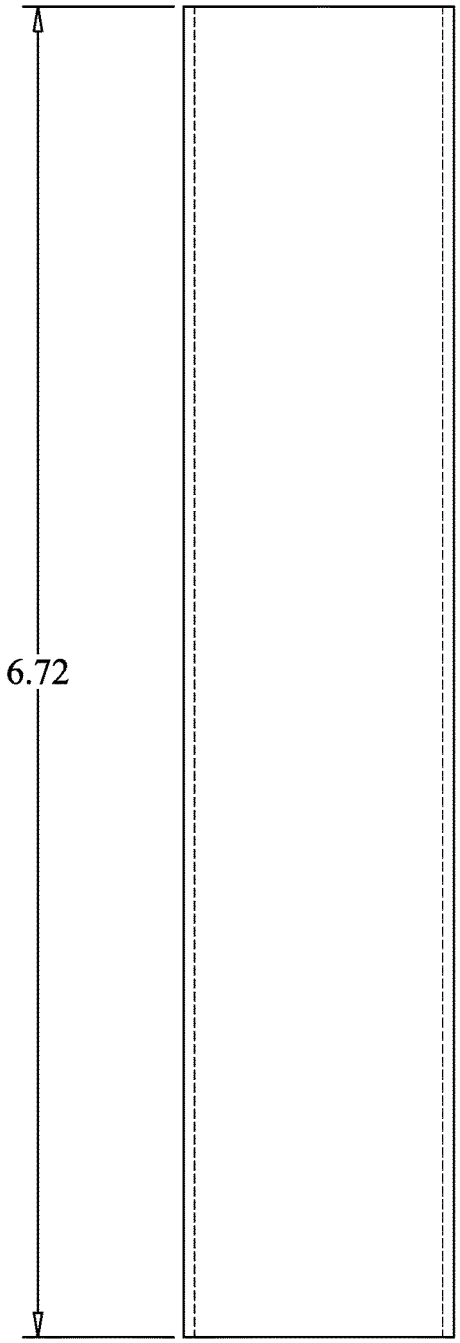
Figure 11C:
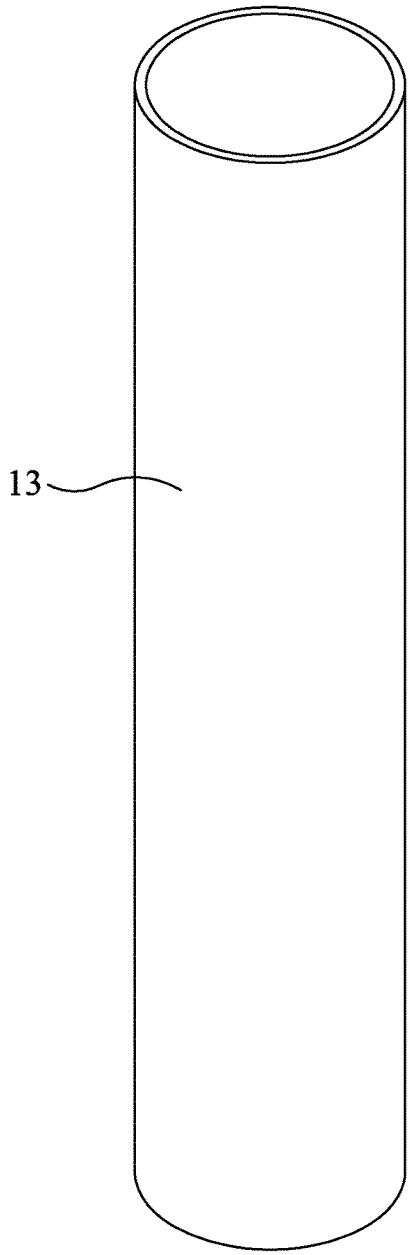
Figure 12A:
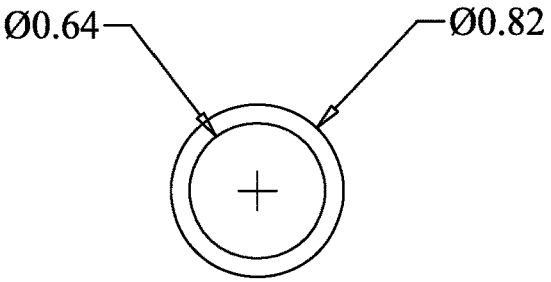
FIGS. 12A-C are the rear, side, and perspective views of an o-ring in one aspect of the subject technology.
Figure 12B:
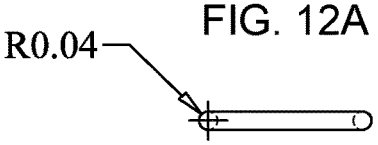
Figure 12C:
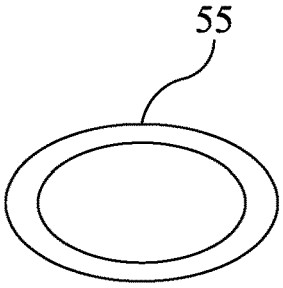
Figure 13A:
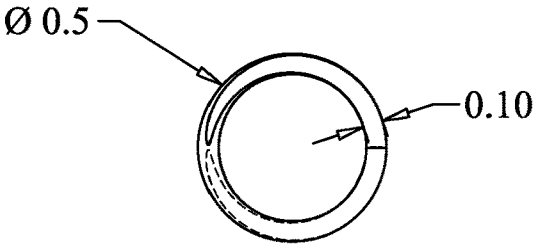
FIGS. 13A-C are the rear, side, and perspective views of a spring in one aspect of the subject technology.
Figure 13B:
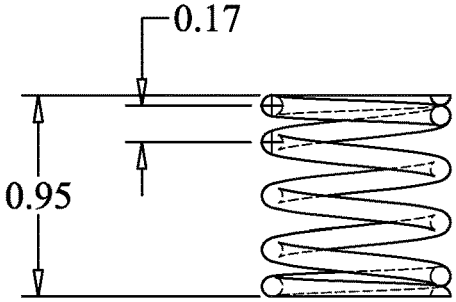
Figure 13C:
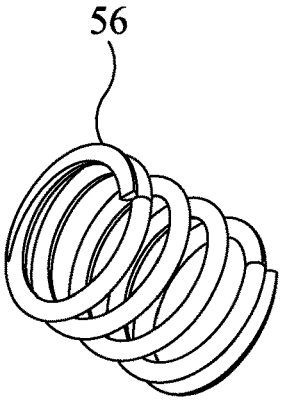
Figure 14B:
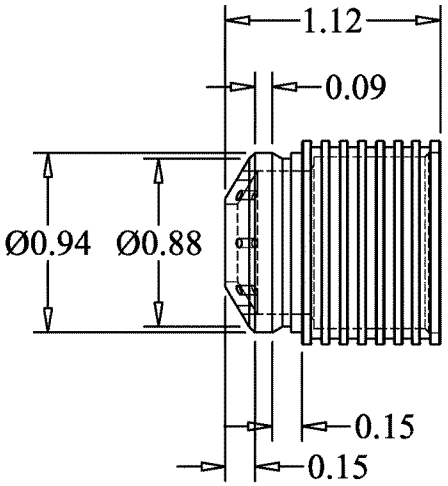
FIGS. 14A-D are the rear, side, and perspective views of a baffle in one aspect of the subject technology.
Figure 14D:
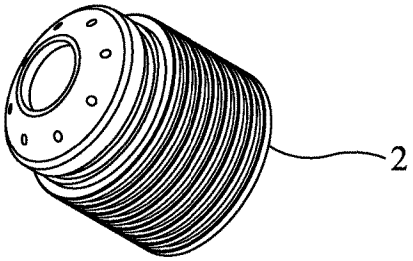
Figure 14A:
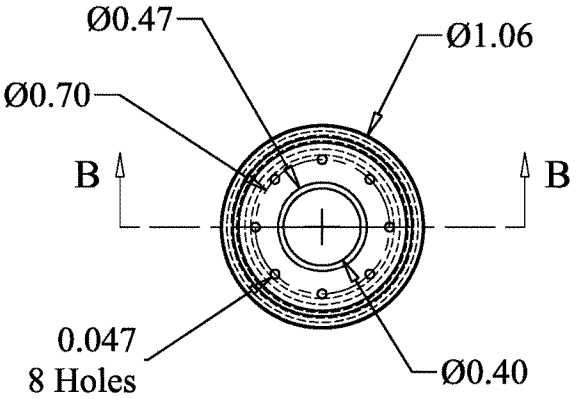
Figure 14C:
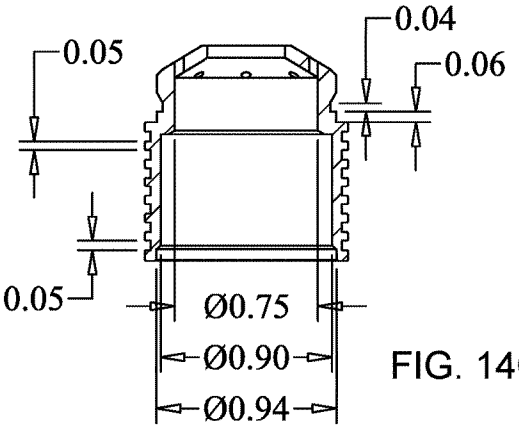
Figure 15B:
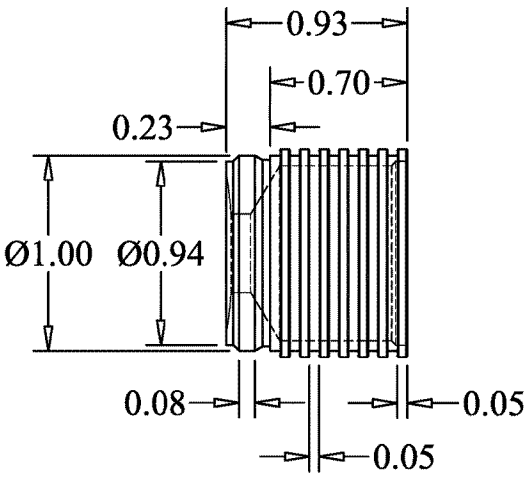
FIGS. 15A-D are the rear, side, side sectional and perspective views of a primary baffle in one aspect of the subject technology.
Figure 15D:
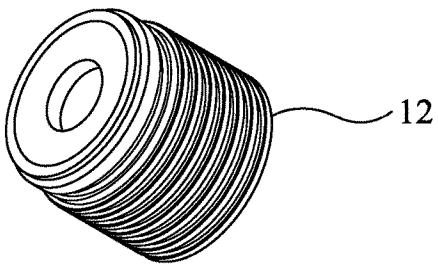
Figure 15A:
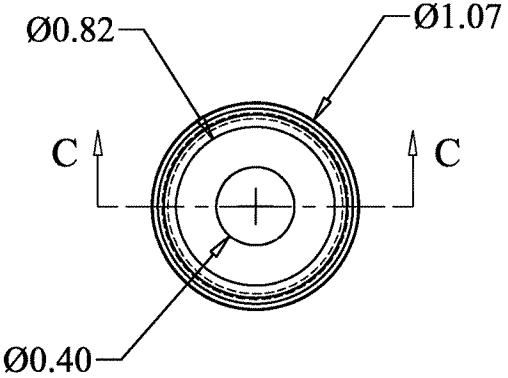
Figure 15C:
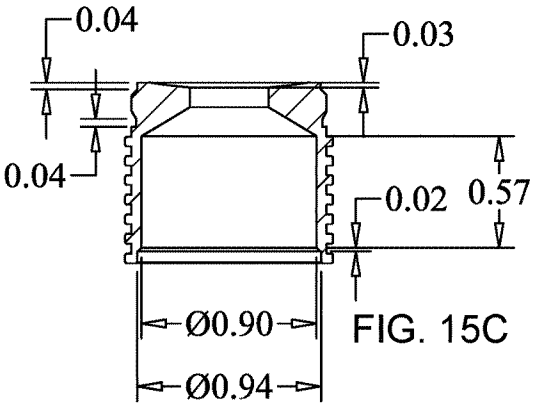
Figure 16B:
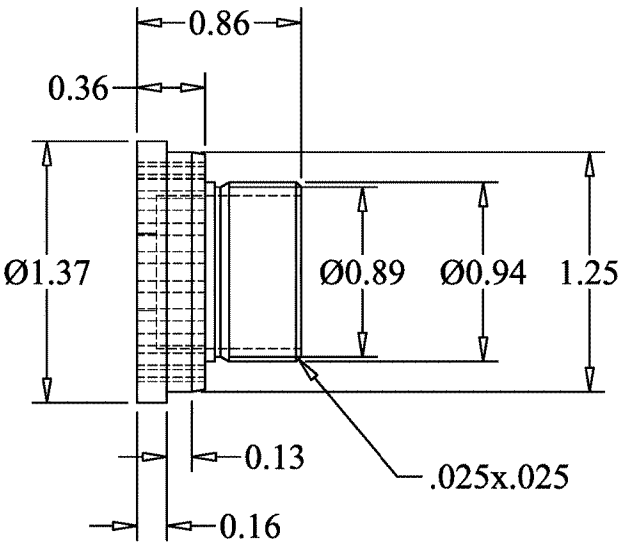
FIGS. 16A-D are the rear, side, side sectional and perspective views of a front cap in one aspect of the subject technology.
Figure 16D:
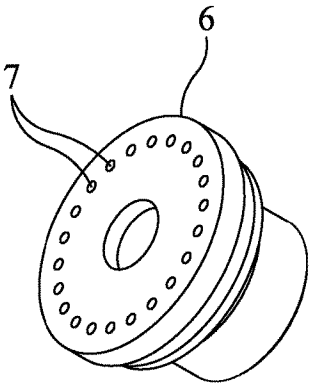
Figure 16A:
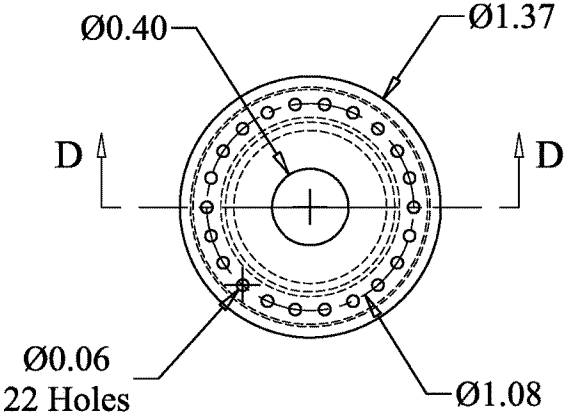
Figure 16C:
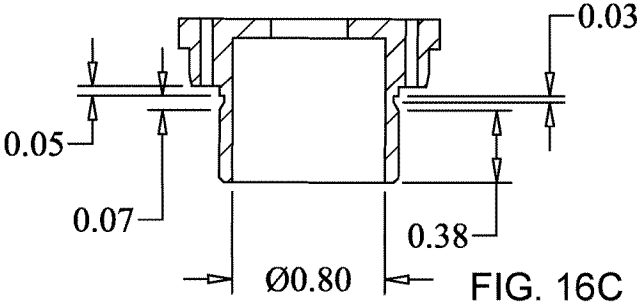
Figure 17:
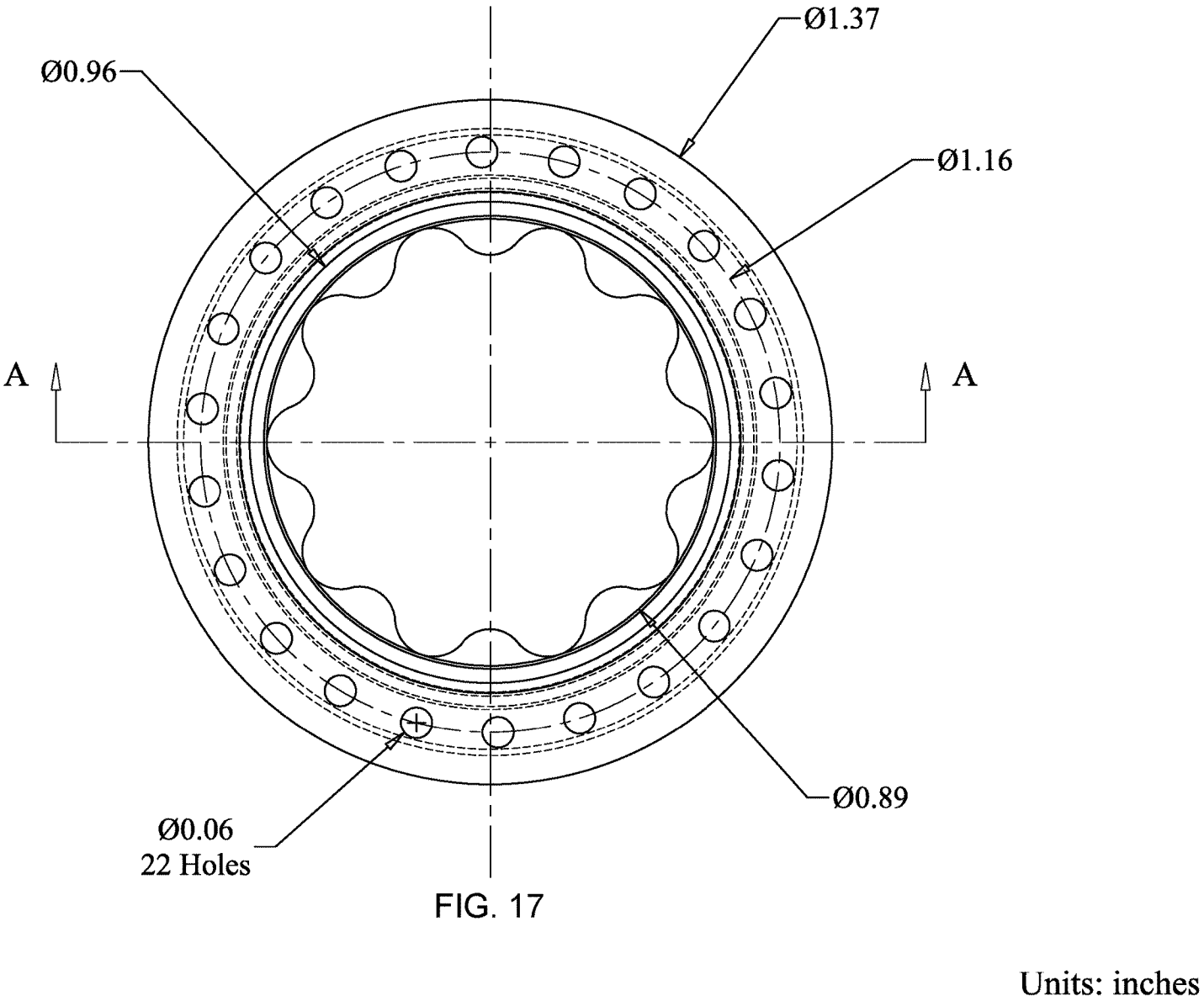
FIG. 17 is an enlarged view of the rear view of the blast chamber of FIG. 10A.
Figure 18B:
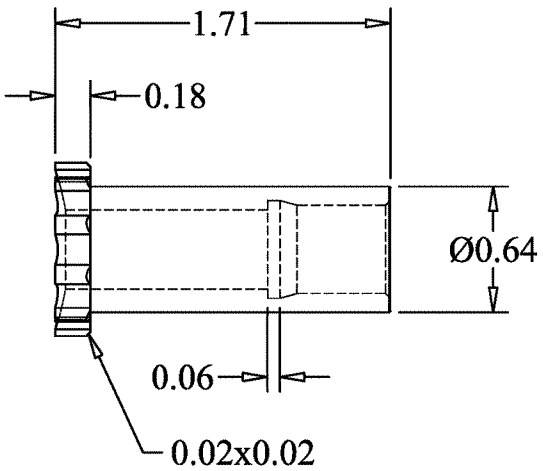
FIGS. 18A-D are the top, side, side sectional and perspective views of an alternative muzzle adapter in one aspect of the subject technology.
Figure 18D:
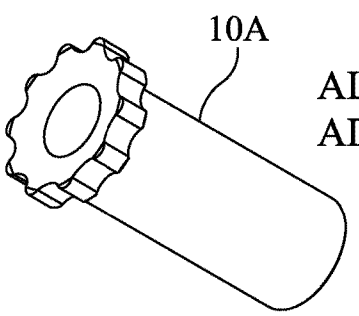
Figure 18A:
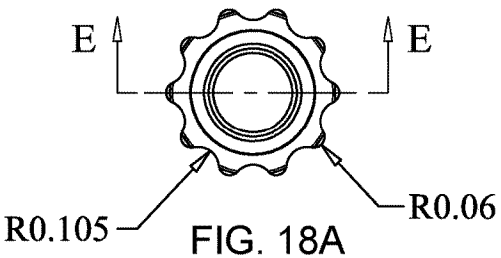
Figure 18C:
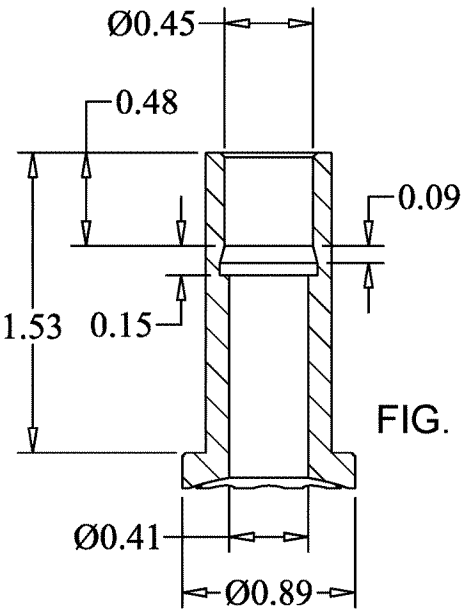
Figure 19B:
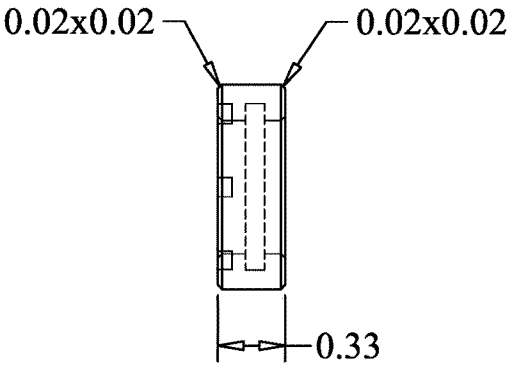
FIGS. 19A-D are the top, side, side sectional and perspective views of a retention clip in one aspect of the subject technology.
Figure 19D:
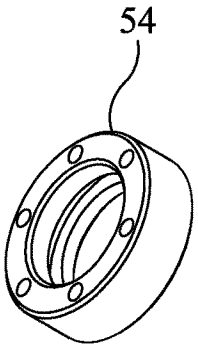
Figure 19A:
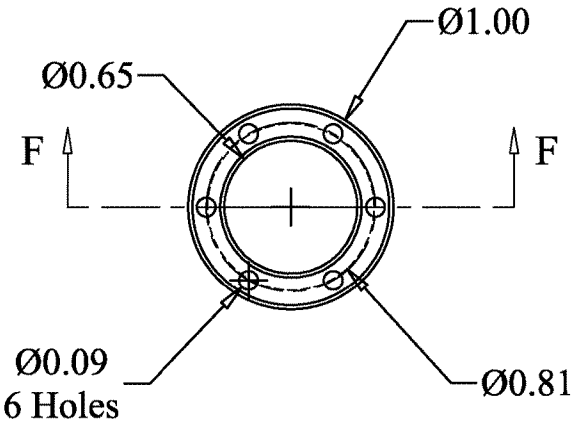
Figure 19C:
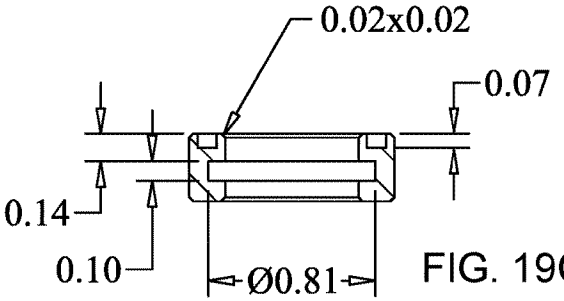

FIG. 7A is the rear view of the muzzle adapter of FIG. 7B assembled inside the blast chamber of FIGS. 6A-D, wherein rear cap 4 is formed in blast chamber 8 (i.e. both parts integral and/or from a unitary piece of material) and fits within the relief cut for interference lock (FIG. 7C) as the muzzle adapter is first inserted within, and then twisted to lock it in place. In one aspect (FIGS. 1 & 2), muzzle adapter 10 is operatively connected to blast chamber 8 with the aid of spring 56, retention clip 54, and o-ring 55.

Figures 3B, 3C, 3D, 3E:
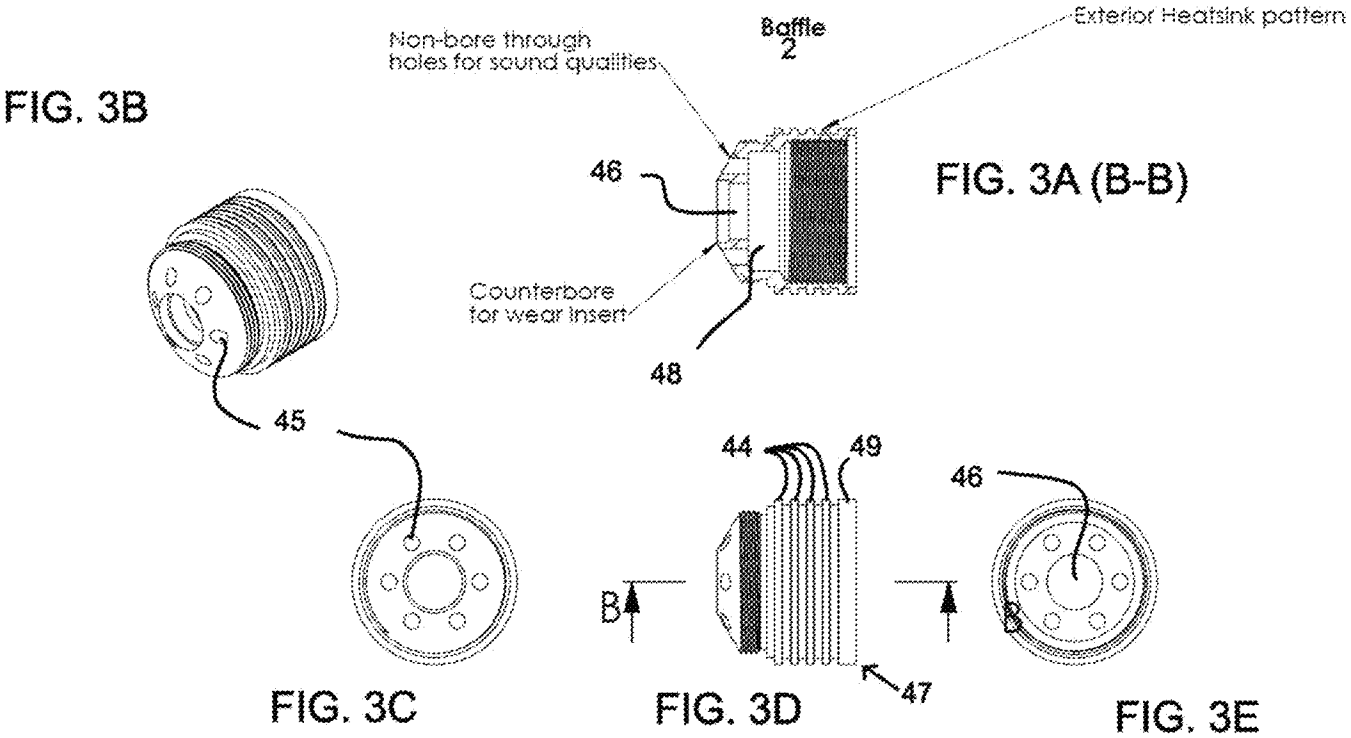
FIG. 3B is the rear side perspective view of the baffle of FIG. 3A.
FIG. 3C is the rear view of the baffle of FIG. 3A.
FIG. 3D is the side elevation view of the baffle of FIG. 3A.
FIG. 3E is the front end view of the baffle of FIG. 3A.
Figure 4A:
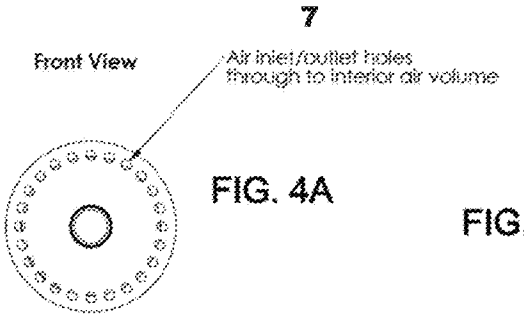
FIG. 4A is the front end view of a front cap in one aspect of the subject technology.
Figure 4B:
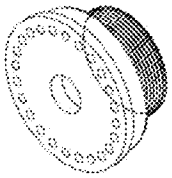
FIG. 4B is a front side perspective view of the front cap of FIG. 4A.
Figure 4D:
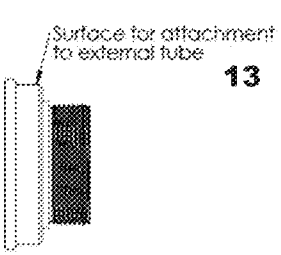
FIG. 4D is the side elevation view of the front cap of FIG. 4A.
Figure 4C:
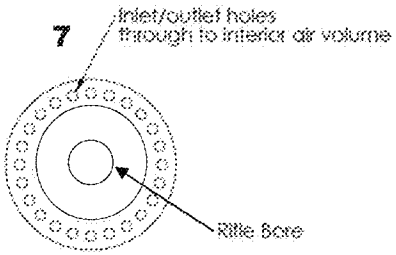
FIG. 4C is the rear end view of the front cap of FIG. 4A.
Figure 5:
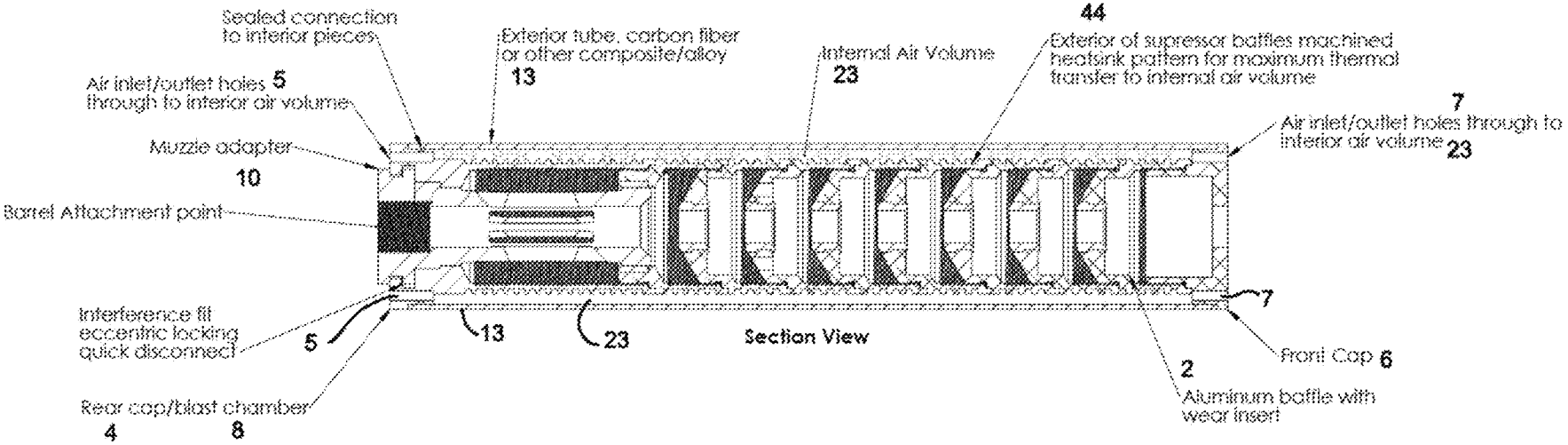
FIG. 5 is the side sectional view of a suppressor according to one aspect of the subject technology.
Figures 6A, 6B, 6C, 6D:
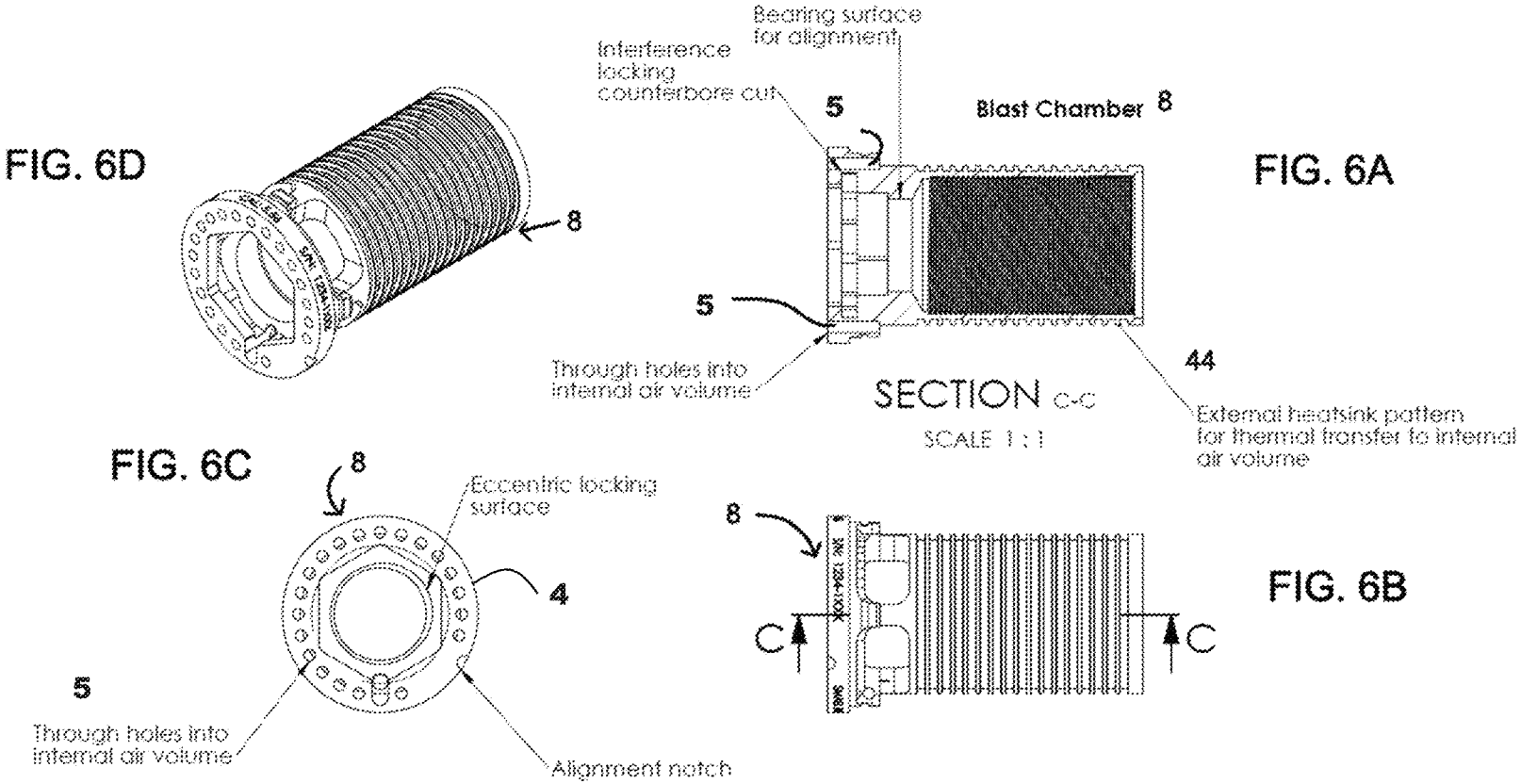
FIG. 6A is the side sectional view of a blast chamber in one aspect of the subject technology.
FIG. 6B is a side elevation view of the blast chamber of FIG. 6A.
FIG. 6C is the rear view of the blast chamber of FIG. 6A.
FIG. 6D is the rear side perspective view of the blast chamber of FIG. 6A.

One or more baffles 2 are utilized. Each baffle 2 has a body portion 47, middle portion 50, and front portion 40. The front portion 40 is tapered as shown (e.g. FIGS. 3A, 3B, 3D, & 8), relative to the middle and body portions 50, 47. Central hole 46, and a plurality of through-holes 45, are disposed through front portion 40. In one aspect, as shown in FIGS. 3B, 3C & 3E, each baffle 2 has 6 through-holes 45. Through-holes 45 aid sound suppression. It should be understood that other configurations and numbers of through-hole arrangements are possible.

Each of body portion 47, middle portion 50, and front portion 40 of baffle 2 have exterior and interior surfaces. An interior chamber 48 is formed in baffle 2 and defined by the interior surfaces of body portion 47, middle portion 50, and front portion 40. Each baffle 2 is adapted such that a projectile can enter central hole 46 and travel through interior chamber 48. Through-holes 45 are operatively connected to interior chamber 48. In one aspect, heat sink fins 44 are disposed on an exterior surface 49 of body portion 47 of baffle 2, and on an exterior surface of blast chamber 8, and on an exterior surface of primary baffle 12. Heat sink fins 44 facilitate heat transfer into air gap (aka internal air volume) 23 that is formed when outer sleeve 13 is attached. In one aspect, (e.g. FIGS. 3A, 3D) the heat sink is formed from a series of circumferentially machined grooves thus increasing the surface area on the exterior surface 49 of body portion 47 of baffle 2. In one aspect, baffle 2, primary baffle 12, and blast chamber 8 are formed from thermally conductive materials, such as metal.

Primary baffle 12 has a body portion 51. An interior chamber 52 is defined within primary baffle 12 having a tapered front portion 58 through which is disposed a central hole 59 and a plurality of through-holes 60. The plurality of through-holes 60 are disposed similarly to through-holes 45 in baffle 2 as depicted in FIGS. 3A through 3E. It should be understood that other configurations and numbers of through-hole arrangements are possible. Primary baffle 12 is adapted such that a projectile can enter central hole 59 and travel through interior chamber 52.

A projectile enters into muzzle adapter 10 and travels through muzzle adapter 10 and blast chamber 8, and then through primary baffle 12, and then through the stacked baffles 2, and then through front cap 6, as does the ignited gas that accompanies the projectile. Sound and heat incidental to the ignited gas and projectile are dissipated in core assembly 3. Consequently, core assembly 3 can be dangerously hot to the touch. Outer sleeve 13 is operatively connected to core assembly 3 such that an air gap 23 exists between exterior surfaces of blast chamber 8, primary baffle 12, and stacked baffles 2. Outer sleeve 13 is preferably made from a thermally insulating material and thus is relatively less hot to the touch than core assembly 3. In one aspect, outer sleeve 13 is secured to front cap 6 and rear cap 4 (rear cap 4 may be integral to blast chamber 8) such that air gap 23 exists between core assembly 3 and outer sleeve 13.

Holes 5 are disposed through rear cap 4. Holes 7 are disposed through front cap 6. Holes (aka apertures) 5 & 7 are in fluid communication with, and facilitate heat dissipation from, air gap 23. In one aspect, the size and quantity of holes 5 relative to holes 7 is adjusted so that expanding hot air is directionally induced to create an air flow. Hot expanding air will naturally expand and flow towards a larger opening. This relative size can be achieved by the relative number of holes and/or the relative size of the holes. It should be understood that such inducement can be caused in either direction. In one aspect, the holes in the front cap are larger than the holes in the rear cap thereby inducing airflow in a forward direction.

In one aspect, the distance from the interior surface of outer sleeve 13 and exterior surfaces of blast chamber 8, primary baffle 12, and stacked baffles 2 is approximately 10 mm. As shown in the various figures, holes 5, 7 are disposed through, and circumferentially spaced around an outer portion of each of rear cap 4 and front cap 6. The circumferential placement, hole size, and quantity of holes can be adjusted to affect air flow and heat dissipation.

In one aspect, outer sleeve 13 is made from a carbon fiber cloth or tow weave utilizing a high temperature resistant carbon fiber resin and/or a composite laminate construction that utilizes a layer of ceramic cloth bonded to the carbon fiber cloth to create a thermal barrier. In one aspect, the components comprising core assembly 3 are fabricated from titanium, aluminum or other corrosion resistant material.

In one aspect, the stacked baffles 2 are screwed together in series, the rear-most of which being threadedly connected to a first end of primary baffle 12. A second end of primary baffle 12 is in turn threadedly connected to blast chamber 8.

Referring to FIGS. 10A-D, 11A-C, 12A-C, 13A-C, 14A-D, 15A-D, 16A-D, 17, 18A-D, and 19A-D, a blast chamber 12, an outer sleeve 13, an o-ring 55, a spring 56, a baffle 2, a primary baffle 12, a front cap 6, an alternative muzzle adapter 10A, and a retention clip 54 are shown in one aspect of the subject technology.

While this invention has been shown and described with respect to a detailed embodiment thereof, it will be understood by those skilled in the art that changes in form and detail thereof may be made without departing from the scope of the claims of the invention.

What is claimed is:

1. A sound suppressor for a firearm comprising:

a baffle disposed between front and rear caps;

each of the front and rear caps having an outer portion;

an outer sleeve connected to the outer portion of each of the front and rear caps such that an air gap exists between an interior surface of the outer sleeve and an exterior surface of the baffle;

each of the front and rear caps having an aperture disposed through the outer portion thereof, each said aperture being in fluid communication with the air gap;

the aperture disposed through the outer portion of the front cap being disproportionately sized relative to the aperture disposed through the outer portion of the rear cap.

2. The sound suppressor of claim 1 further comprising:

the baffle is formed from a plurality of baffles in a stacked arrangement.

3. The sound suppressor of claim 1 further comprising:

the baffle having a heat sink disposed on an exterior surface thereof.

4. The sound suppressor of claim 3 further comprising:

the heat sink disposed on an exterior surface of the baffle comprising a series of circumferentially machined grooves.

5. The sound suppressor of claim 1 further comprising:

the aperture disposed through the outer portion of the front cap comprising a plurality of apertures;

the aperture disposed through the outer portion of the rear cap comprising a plurality of apertures.

6. The sound suppressor of claim 1 further comprising:

a primary baffle removably connected between the baffle and a blast chamber, the blast chamber being removably connected between the primary baffle and the rear cap.

7. The sound suppressor of claim 6 further comprising:

the blast chamber and the rear cap being formed from a unitary piece of material.

* * * * *